US005450998A

United States Patent [19]

Esse et al.

[11] Patent Number: 5,450,998

[45] Date of Patent: Sep. 19, 1995

[54] FABRICATED ON DEMAND TOTES

[75] Inventors: Robert L. Esse, Monticello; Barry S. Mikulski, Plymouth, both of Minn.; Raymond L. Russell, Cedar Falls, Iowa

[73] Assignee: General Mills, Inc., Minneapolis, Minn.

[21] Appl. No.: 169,267

[22] Filed: Dec. 20, 1993

[51] Int. Cl.[6] ..... B65D 5/32

[52] U.S. Cl. ..... 229/23 R; 220/443; 229/192; 229/918; 229/919

[58] Field of Search ..... 229/23 R, 23 BT, 192, 229/915, 918, 919, 198.1; 206/386, 600; 220/443

[56] References Cited

U.S. PATENT DOCUMENTS

| | | | |
|---|---|---|---|
| 1,664,308 | 3/1928 | Miller | 229/919 |
| 3,021,044 | 2/1962 | Schubert . | |
| 3,097,781 | 7/1963 | Masi | 229/23 R |
| 3,162,351 | 12/1964 | Rudofski | 229/918 |
| 3,291,364 | 12/1966 | Fischer . | |
| 3,294,306 | 12/1966 | Areddy . | |
| 3,568,912 | 3/1971 | deSimas . | |
| 3,650,459 | 3/1972 | Tucker | 229/23 R |
| 3,899,123 | 8/1975 | Stollberg et al. | 229/192 |
| 3,995,736 | 12/1976 | Lawson et al. . | |
| 4,081,124 | 3/1978 | Hall | 229/23 BT |
| 4,296,860 | 10/1981 | Hsu et al. . | |
| 4,762,226 | 8/1988 | Gatton . | |
| 4,874,125 | 10/1989 | Bates | 229/918 |
| 5,111,938 | 5/1992 | Soprano et al. . | |

FOREIGN PATENT DOCUMENTS

| | | | |
|---|---|---|---|
| 1165276 | 10/1958 | France | 229/198.1 |

OTHER PUBLICATIONS

"Corrugated and Solid Fibre Handbook," ©1976 Fibre Box Association, Cover page and pp. 1, 33–44, and 48A–D.

"Internal Flange Bliss" 2A & Cut Corner 3A, ©1990 Moen Industries.

The Wiley Encyclopedia of Packaging Technology, John Wiley & Sons, 1986, pp. 66–69.

*Primary Examiner*—Gary E. Elkins

*Attorney, Agent, or Firm*—L. MeRoy Lillehaugen; John A. O'Toole; Alan D. Kamrath

[57] ABSTRACT

A tote (10) is disclosed in its preferred form including a tubular body formed from four side panels (12–15) preferably of identical construction and including top and bottom panels (16, 18) preferably of construction. The side panels (12–15) each include flaps (26, 28) extending from the opposite side edges (22, 24) of a central portion (20). The flaps (26, 28) overlap and are secured to the central portion (20) of the adjacent side panels (12–15) and extend in two, nonparallel directions from the corners of the tubular body defined by the side edges (22, 24) to create a V-shaped corner post at each corner of the tubular body. A pleat is formed in each of the central portions (20) of the side panels (12–15) to increase compression strength and rigidity of the side panel (12–15). In the preferred form, the pleat in the side panels (12–15) is formed by two planar walls (40, 44) interconnected together at an acute angle by their inner edges (42) and interconnected to two further walls (36, 48) at an obtuse angle by their outer edges (38, 46). One or more patches (50) are bonded to the outer face of the walls (36, 48) opposite the pleat of each side panel (12–15) for reducing any tendency the side panel (12–15) to bulge. Similarly, the top and bottom panels (16–18) can include V-shaped pleats (60) secured to their inner faces to increase compression strength against clamping or gripping forces and for reducing any tendency of the top and bottom panels (16, 18) of deflecting when the totes (10) are stacked.

26 Claims, 2 Drawing Sheets

FABRICATED ON DEMAND TOTES

BACKGROUND

The present invention generally relates to totes, particularly relates to totes which can be fabricated on demand, and specifically relates to totes which are formed of panels of a single layer of corrugated board, and preferably double-wall corrugated board.

During the manufacture of many products into their final commercialized form, it is often desired to temporarily store or transport partially manufactured products, components, or the like. Totes are often utilized to contain such products, components, or the like in bulk while allowing handling by forklifts, trucks, or the like. Especially when transported to other facilities, it is desired that the totes be formed of lightweight material. The use of lightweight material is important in minimizing the overall mass required to be handled and/or transported. Further, reduction in the mass and/or volume of the material forming the tote maximizes the total volume for holding products, components, or the like while reducing the amount of material requiring disposal. Additionally, the reduction in the amount of material required to form the tote typically translates into reduction in costs. Double-wall corrugated board has been one material from which totes have been manufactured.

Prior totes were conventionally constructed of a double-wall body laminated to a double-wall corrugated liner and required extensive labor to erect. Prior corrugated board totes were conventionally utilized more than one time. To allow reuse, it was necessary to transport the emptied tote back to the product manufacturing facility after each use. In cases where the totes were used to contain food articles, it is required that the totes be fumigated to avoid infestation. Thus, increased transportation, sanitation, and handling costs are associated with reuse. Furthermore, fumigation raises health and environmental concerns.

Thus, a need continues to exist for improved totes which overcome the many disadvantages and shortcomings of existing tote designs. Specifically, a need exists for totes which reduce the amount of material required in formation to thus reduce expense of formation and use while still providing the necessary rigidity and compressive strength required for use and stacking. Additionally, a need exists for totes which can be easily fabricated preferably utilizing automated equipment from a relatively small number of components thus reducing labor and inventory costs. Further, a need exists for discardable totes which can be economically discarded after each use to eliminate transportation, sanitation, and handling expenses associated with reuse of prior totes. Also, a need exists for discardable totes requiring less adhesive and being more readily recyclable by paper mills.

SUMMARY

Surprisingly, the above and other needs in the field of product totes or like containers can be satisfied by providing, in the preferred form, a tubular tote body formed from interconnected, generally flat side panels wherein the side panel interconnection corners include first and second flaps integrally connected to and extending from central portions of the side panels, overlapping and secured to the central portions, and extending in two, nonparallel directions from the side panel interconnection corners.

In other preferred aspects of the present invention, the panels of the tote include pleats located between their side edges and extending inwardly of the outer face to add to the compression strength of the panels and to minimize bulging of the panels. In the most preferred form, a member such as at least a first patch or a central wall is bonded to the outer face and extends across the pleat further reducing any tendency of the panel to deflect.

In a preferred aspect of the present invention, the tubular tote body is formed from multiple side panels and in the most preferred form from four identical side panels.

It is thus an object of the present invention to provide a novel tote.

It is further an object of the present invention to provide such a novel tote which can be fabricated on demand and preferably at the filling site.

It is further an object of the present invention to provide such a novel tote which reduces the amount of material required in formation.

It is further an object of the present invention to provide such a novel tote providing the necessary rigidity and compressive strength while minimizing the amount of materials needed.

It is further an object of the present invention to provide such a novel tote which can be easily fabricated.

It is further an object of the present invention to provide such a novel tote which can be fabricated using automated equipment.

It is further an object of the present invention to provide such a novel tote formed from a relatively small number of components.

It is further an object of the present invention to provide such a novel tote which can be economically discarded after each use.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
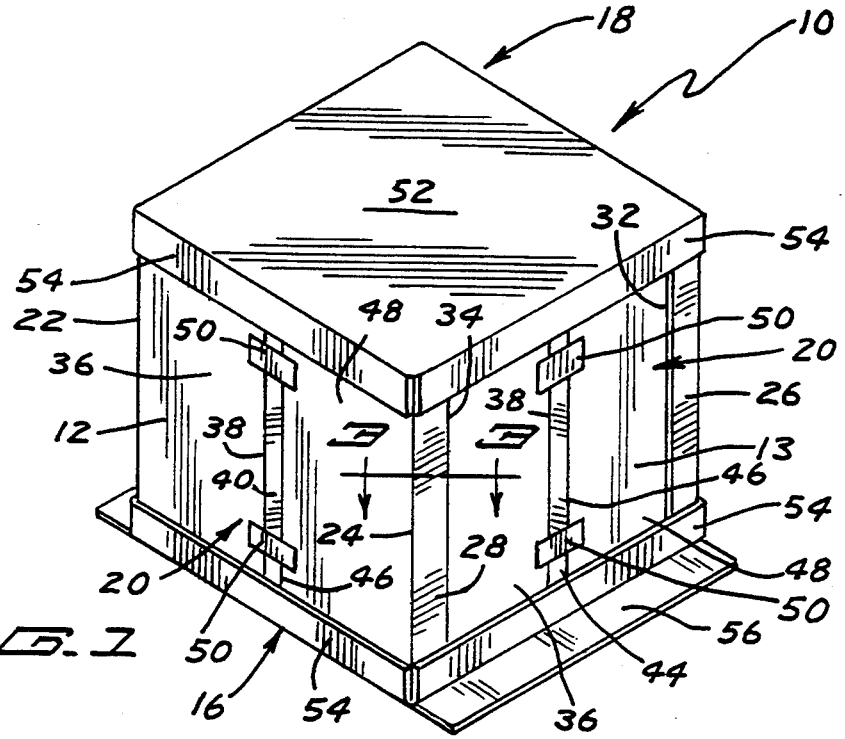
FIG. 1 shows a perspective view of a fabricated-on-demand tote according to the preferred teachings of the present invention.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "inside", "outside", "front", "back", "outer", "inner", "upper", "lower", "height", "width", "length", "end", "side", "horizontal", "vertical", and similar terms are used herein, it should be understood that these terms have reference only to the structure shown in the drawings as it would appear to a person viewing the drawings and are utilized only to facilitate describing the invention.

DESCRIPTION

Figure 3:
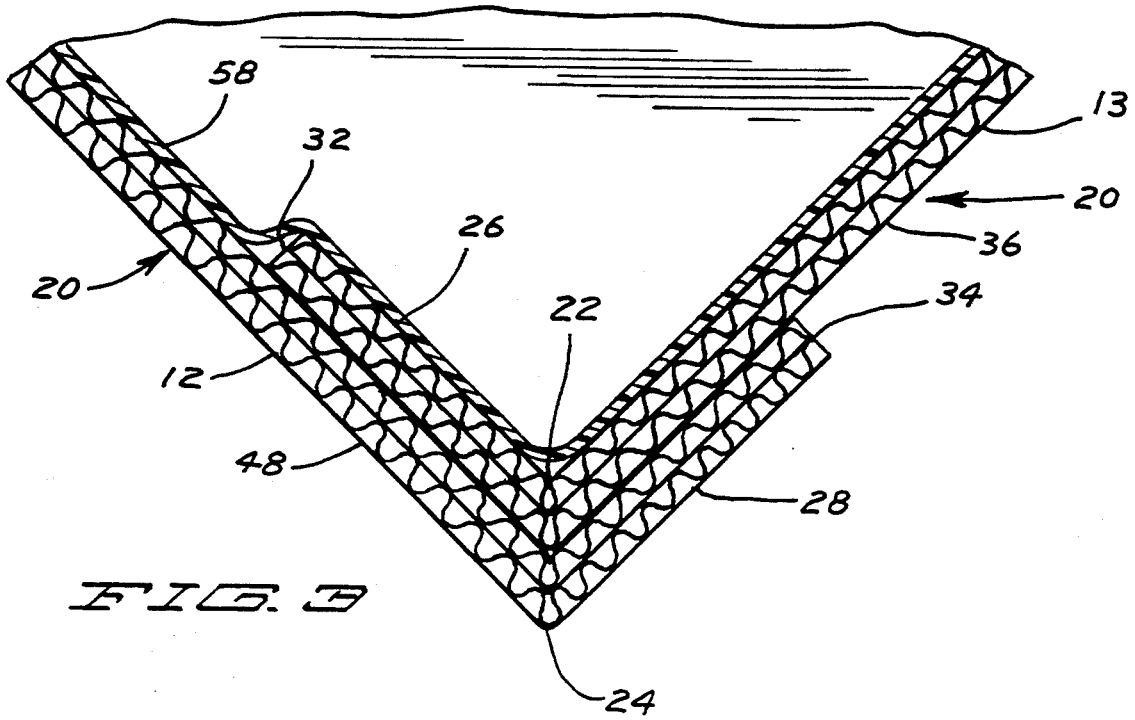
FIG. 3 shows a partial, cross-sectional view of the fabricated-on-demand tote of FIG. 1 according to section line 3—3 of FIG. 1.
Figure 2:
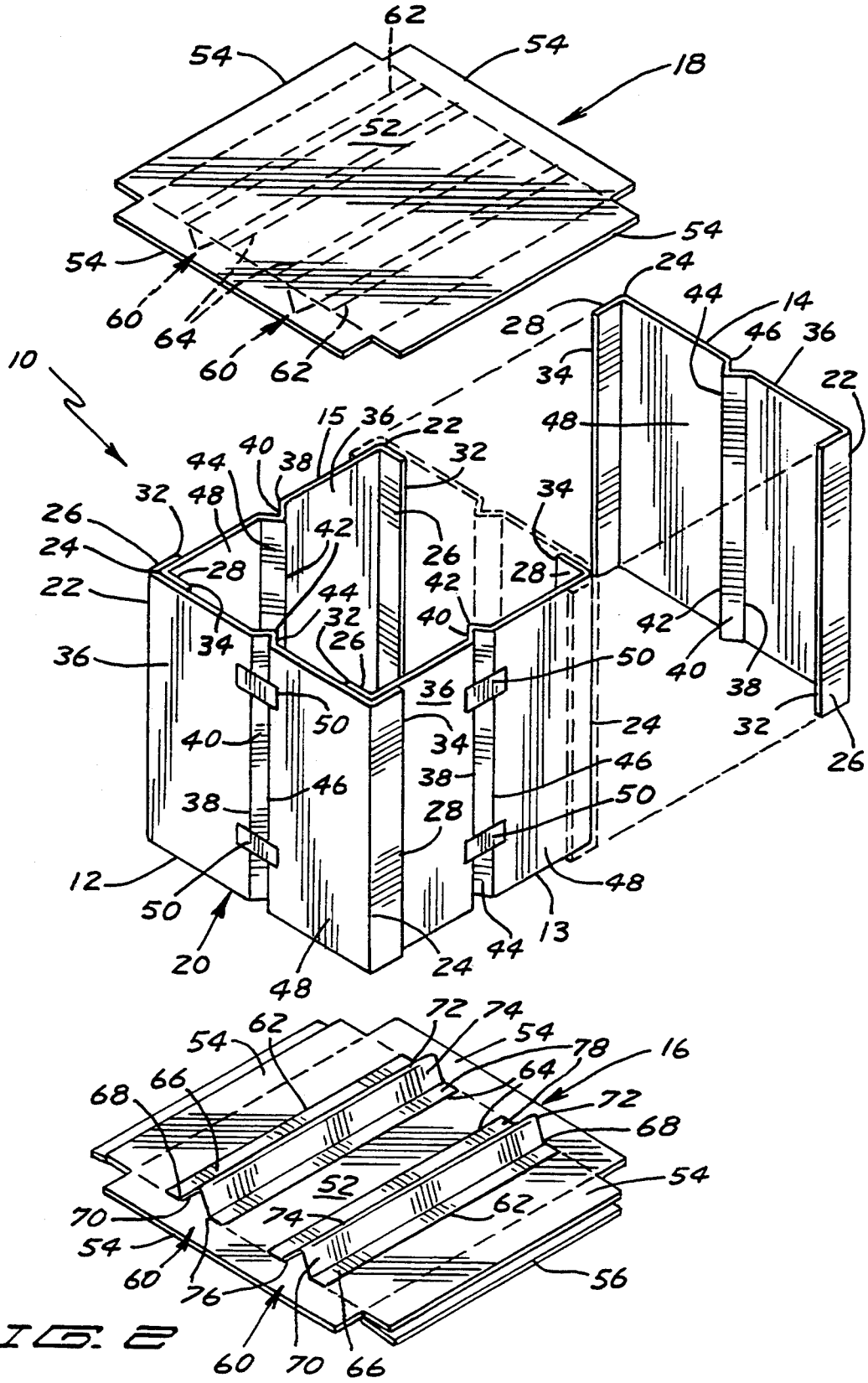
FIG. 2 shows an exploded perspective view of the fabricated-on-demand tote of FIG. 1.

A fabricated on demand tote according to the preferred teachings of the present invention is shown in the drawings and generally designated 10. Generally, tote 10 includes four side panels 12, 13, 14, and 15, a bottom panel 16, and a top panel 18. In the most preferred form and as best seen in FIG. 3, panels 12–16 and 18 are formed of a single layer of double-wall corrugated board. The flute sizes of the double-wall corrugated board of the preferred form can be tailored to match the weight of the product to be contained by tote 10. In the most preferred form, side panels 12–15 are of identical construction and design, and panels 16 and 18 are of identical construction and design. Thus, totes 10 according to the preferred teachings of the present invention can be formed of only two, different components, reducing inventory costs. However, it can be appreciated that panels 12–15 and/or panels 16 and 18 can be formed of different constructions and/or designs according to the preferred teachings of the present invention including but not limited to panels 12–15 having differing widths.

Panels 12–15 each include a generally flat central portion 20 having first and second, parallel side edges 22 and 24. Side edges 22 and 24 are continuously integrally connected to side edges 22 and 24 of first and second, planar flaps 26 and 28, respectively, about fold lines. The opposite, parallel side edges 32 and 34 of flaps 26 and 28, respectively, are free. The width of flaps 26 and 28 between edges 22 and 24 and edges 32 and 34, respectively, are equal in the most preferred form and substantially smaller than and particularly equal to one-eighth the width of central portion 20 between side edges 22 and 24. The height of panels 12–15 in the most preferred form is generally equal to the width of central portion 20 between side edges 22 and 24. However, the height of panels 12–15 can be varied as desired such as in relation to the density of the product to be contained in tote 10.

In the most preferred form, central portion 20 of each panel 12–15 includes a first planar wall 36 including side edge 22 and a parallel, spaced wall edge 38 integrally connected to wall edge 38 of a second planar wall 40 about a fold line. Wall 40 includes a wall edge 42 parallel to and spaced from wall edge 38 and integrally connected to wall edge 42 of a third, planar wall 44 about a fold line. Wall 44 includes a wall edge 46 parallel to and spaced from wall edge 42 and integrally connected to wall edge 46 of a fourth, planar wall 48 about a fold line. Wall 48 includes side edge 24 which is parallel to and spaced from wall edge 46. In the preferred form, the widths of walls 40 and 44 between edges 38 and 42 and edges 42 and 46, respectively, are equal and in the most preferred form, the widths of walls 36 and 48 between edges 22 and 38 and edges 46 and 24, respectively, are equal. In the most preferred form, walls 40 and 44 are in the shape of a V and extend at an acute angle relative to each other from edge 42. Wall 40 extends at an obtuse angle from edge 38 relative to wall 36 equal to the angle wall 44 extends from edge 46 relative to wall 48, with edges 38 and 46 being spaced. Walls 36 and 48 are located in the same plane and include the outer face of panels 12–15 which is planar in the most preferred form. Flap 26 extends generally perpendicular to wall 36 and flap 28 extends generally perpendicular to wall 48 in the same direction as and parallel to flap 26. In the most preferred form, the height of edge 42 from the plane of the outer face of walls 36 and 48 is generally equal to one-twelfth the width of central portion 20 between edges 22 and 24.

In the preferred form, central portion 20 of each panel 12–15 includes at least a first patch 50 bonded to the outer face of walls 36 and 48 and extending across and between edges 38 and 46 on the outer face opposite to walls 40 and 44. It can then be appreciated that two or more patches 50 can be utilized in each panel 12–15 as desired or necessary.

To erect tote 10 according to the preferred teachings of the present invention, flaps 26 and 28 of panels 12–15 overlap and are secured to walls 36 and 48 of adjacent panels 12–15, with the corners of the tote body being defined by side edges 22 and 24 of side panels 12–15. Particularly, in the most preferred form, the inside surface of flap 26 of panel 12 abuts with and is secured to the outside surface of wall 48 of panel 15 and the outside surface of flap 28 of panel 15 abuts with and is secured to the inside surface of wall 36 of panel 12, with edge 22 of panel 12 being vertical and located outside of and abutting with edge 24 of panel 15. Likewise, the inside surface of flap 28 of panel 12 abuts with and is secured to the outside surface of wall 36 of panel 13 and the outside surface of flap 26 of panel 13 abuts with and is secured to the inside surface of wall 48 of panel 12, with edge 24 of panel 12 being vertical and located outside of and abutting with edge 22 of panel 13. Similarly, the inside surface of flap 26 of panel 14 abuts with and is secured to the outside surface of wall 48 of panel 13 and the outside surface of flap 28 of panel 13 abuts with and is secured to the inside surface of wall 36 of panel 14, with edge 22 of panel 14 being vertical and located outside of and abutting with edge 24 of panel 13. Likewise, the inside surface of flap 28 of panel 14 abuts with and is secured to the outside surface of wall 36 of panel 15 and the outside surface of flap 26 of panel 15 abuts with and is secured to the inside surface of wall 48 of panel 14, with edge 24 of panel 14 being vertical and located outside of and abutting with edge 22 of panel 15. Thus, in the most preferred form as shown and described, edges 22 and 24 of panels 12 and 14 define the outside corners of the tote body while edges 22 and 24 of panels 13 and 15 define the inside corners of the tote body of tote 10 according to the preferred teachings of the present invention.

It can then be appreciated that the most preferred overlapping of flaps 26 and 28 as shown and described is advantageous for providing a smooth, unobstructed surface free of flaps 26 and 28 located outside and along the outer face of central portions 20 of panels 12 and 14 (aside from patch 50 and flaps 54 of panels 16 and 18) which can be easily clamped or gripped by a clamp truck or the like for moving tote 10 according to the preferred teachings of the present invention.

In the preferred form, panels 16 and 18 each include a horizontal, planar, square wall 52 having lengths along any of its sides generally equal to the widths of panels 12–15 between side edges 22 and 24 which in the most preferred form are 48 inches (122 cm). Panels 16 and 18 each further include a flap 54 continuously integrally connected to each side of wall 52 about a fold line. Flaps 54 can extend generally perpendicularly from wall 52 in the same direction, with the inside surfaces of flaps 54 abutting with and being secured to the outer face of central portions 20 of panels 12–15 when abutting and secured together.

In the most preferred form, wall 52 of one or both panels 16 and 18 includes reinforcement pleats 60 secured to the inner surfaces thereof, with two, separate pleats 60 being provided on wall 52 in the most preferred form. Specifically, each pleat 60 includes a first planar wall 66 including a side edge 62 and a parallel, spaced wall edge 68 integrally connected to wall edge 68 of a second planar wall 70 about a fold line. Wall 70 includes a wall edge 72 parallel to and spaced from wall edge 68 and integrally connected to wall edge 72 of a third, planar wall 74 about a fold line. Wall 74 includes a wall edge 76 parallel to and spaced from wall edge 72 and integrally connected to wall edge 76 of a fourth, planar wall 78 about a fold line. Wall 78 includes a side edge 64 which is parallel to and spaced from wall edge 76. In the preferred form, the widths of walls 70 and 74 between edges 68 and 72 and edges 72 and 76, respectively, are equal and in the most preferred form, the widths of walls 66 and 78 between edges 62 and 68 and edges 76 and 64, respectively, are equal. In the most preferred form, walls 70 and 74 are in the shape of a V and extend at an acute angle relative to each other from edge 72. Wall 70 extends at an obtuse angle from edge 68 relative to wall 66 equal to the angle wall 74 extends from edge 76 relative to wall 78, with edges 68 and 76 being spaced. Walls 66 and 78 are located in the same plane. In the most preferred form, the height of edge 72 from the plane of the outer face of walls 66 and 78 is generally equal to one-eighth the width of central portion 20 between edges 22 and 24.

In the preferred form, the outer face of walls 66 and 78 of each pleat 60 is bonded to the inner face of wall 52, with wall 52 extending across and between edges 68 and 76 on the outer face opposite to walls 70 and 74.

In the most preferred form, pleats 60 are formed of double-wall corrugated board and are formed separate from each other for ease of automatic fabrication. However, it can be appreciated that walls 78 of first and second pleats 60 can be integrally connected, and if desired edges 62 of pleats 60 can be coextensive with the sides of wall 54. In such an arrangement, one or both of panels 16 and/or 18 and such integral pleats 60 could be formed of a single-wall corrugated board.

In the preferred form, the length of pleats 60 is generally equal to the width of panels 13 and 15 between side edges 22 and 24 and extends across the full span of wall 54 from side to side parallel to and spaced from panels 12 and 14. It can then be appreciated that in the preferred form, pleats 60 are oriented so as to prevent damage to tote 10 when a clamping or gripping force is placed against panels 12 and 14 by a clamp truck or the like during stacking, loading, and unloading of totes 10. Thus, pleats 60 add to the compression strength of totes 10 to prevent panels 12 and 14 from collapsing toward each other.

In the most preferred form, a corrugated or solid fiber slipsheet 56, a totally corrugated pallet, or the like is constructed, placed and secured to the outside surface of bottom panel 16. Additionally, in the most preferred form, tote 10 includes a plastic liner bag 58 such as formed by drawing a section of blown tube film from a roll and sealing the bottom prior to insertion and gluing into panels 12–15 when abutted and secured together and upstanding from and secured to bottom panel 16. After liner bag 58 has been filled with product, the top of bag 58 can be tied such as with a plastic strip, heat or otherwise sealed, rolled down or otherwise closed. After the top of bag 58 has been closed and after securement of top panel 18, totes 10 can be double stacked and secured together, specifically with the outside surface of wall 52 of top panel 18 of the lower tote 10 abutting with and secured to the outside surface of wall 52 of bottom panel 16 of the upper tote 10 such as by gluing. The bonding of totes 10 into units of 2 facilitates warehouse handling and greatly reduces shipping damage which results from tote misalignment in the truck trailer.

Securement of flaps 26 and 28 to walls 36 and 48 can be accomplished by any suitable means such as but not limited to bonding or adhesion. Due to the simple construction of tote 10 according to the teachings of the present invention, less adhesive is required such that panels 12–16 and 18 can be more readily recycled by paper mills.

Now that the basic construction of tote 10 according to the preferred teachings of the present invention has been explained, advantages and subtle features of tote 10 can be set forth and appreciated. Specifically, totes prior to the present invention conventionally utilized a double-corrugated liner laminated to or placed inside a double-wall body. Thus, a prior tote having a volume of 40 cubic feet (1.1 cubic meters) was constructed of 45 pounds (16.8 kilograms) of corrugated material and required approximately 3- to 4-line personnel to assemble and cap. Prior totes were typically utilized multiple times to reduce material costs but which increased transportation, sanitation, handling, and management costs including but not limited to fumigation costs when used for food products.

Tote 10 according to the teachings of the present invention utilizes a single layer of double-wall corrugated board and thus significantly reduces the amount of material utilized. Specifically, tote 10 having a volume of 60 cubic feet (1.7 cubic meters) can be constructed according to the teachings of the present invention utilizing 23–25 pounds (8.6–9.3 kilograms) of corrugated material or in other words less than one-half the amount of material per unit volume of prior totes. The strength and rigidity of tote 10 are obtained due to the unique construction of side panels 12–15 according to the preferred teachings of the present invention. Specifically, the overlapping of flaps 26 and 28 onto central portions 20 creates a corner post at each corner of tote 10 defined by edges 22 and 24, with each corner post being V-shaped and in the most preferred form right-angle shaped. Specifically, as best seen in FIG. 3, each corner post is comprised of four layers of corrugated material, i.e. a double layer of wall 36 and 48 and a double layer of flap 26 and 28. The leg portions of the corner post at each corner extend in two, nonparallel directions and generally perpendicular to each other in the most preferred form at each of the corners of the tubular tote body of tote 10. This dual leg corner post overlap at each corner provides rigidity and compression strength to tote 10.

Further, tote 10 according to the preferred teachings of the present invention is formed from separate, independent panels 12–16 and 18, with panels 16 and 18 being independent from and closing the open top and bottom ends of the tubular tote body formed by panels 12–15. Thus, tote 10 allows maximizing the volume of product to be contained while still allowing practical handling of tote 10 before set up. In particular, a flat blank forming a tote of a volume of 60 cubic feet (1.7 cubic meters) would have a size of about 82½ inches (210 cm) by 96 inches (244 cm) which is too big to make on most equipment in the field and too big to handle practically. However, tote 10 according to the teachings of the present invention of the same volume includes panels 12–16 and 18 of a manageable size and specifically having a size of about 60 inches (152 cm) by 60 inches (152 cm).

Additionally, the folds at edges 38, 42, and 46 and walls 40 and 44 form a pleat in central portion 20 between, parallel to, and intermediate side edges 22 and 24 and extending inwardly of the outer face of panels 12–15, adding to the compression strength of panels 12–15 and tote 10. The outward bulging of panels 12–15 is also minimized by the pleat, with patches 50 reducing any tendency for panels 12–15 to bulge. In this regard, the particular shape of the pleat formed by planar walls 40 and 44 interconnected to planar walls 36 and 48 by linear fold lines defined by edges 38, 42, and 46 is believed advantageous in maximizing compression strength and rigidity of panels 12–15.

It should be noted that compression strength and rigidity of tote 10 is critical in allowing stacking of totes 10 which is often four high in warehouses to maximize the use of floor space. In this regard, pleats 60 of panels 16 and 18 according to the preferred teachings of the present invention are believed to be particularly advantageous. Specifically, when totes 10 are stacked and especially when containing very dense product, bottom panel 16 of the upper tote 10 may have a tendency to bow downward between its sides and into the tubular tote body formed by panels 12–15 of the lower tote 10. It can then be appreciated that pleats 60 of panel 18 of the lower tote 10 reinforces panel 18 against such downward bowing from the mass of totes 10 or other objects stacked thereon. Similarly, pleats 60 of panel 16 of tote 10 reinforces panel 16 against downward deflection due to the mass of the product contained by tote 10. It can be appreciated that downward deflection of panel 16 of the upper tote 10 places greater deflection force on panel 18 of the lower tote 10 when totes 10 are stacked and thus is undesirable. However, it may be desirable to omit pleats 60 on bottom panel 16 if they would undesirably interfere with the placement and/or removal of product inside of tote 10 and if panels 18 have a sufficient strength to prevent detrimental deflection when totes 10 are stacked.

Due to the preferred construction of panels 12–15 of tote 10 according to the teachings of the present invention, tote 10 lends itself towards and can be automatically formed and/or erected at the fill site by fully automated equipment operated by a single person, thus significantly reducing the labor requirements. Further, in the preferred form, tote 10 is utilized only once, being discarded after the contents have been removed therefrom to eliminate shipping of the previously utilized and erected tote 10 back to the production facility. However, due to the reduced materials required, the reduced handling, sanitation, and transportation costs, and reduced labor required in forming, erecting and filling, tote 10 according to the teachings of the present invention results in savings of more than one-third of the costs per volume of product shipped of prior multiple-use totes as used in the food industry.

Further, the preferred construction of panels 12–16 and 18 of tote 10 according to the teachings of the present invention can be easily constructed preferably at the production facility of the product. Specifically, the correctly sized material from which panels 12–16 and 18 are formed such as double-wall corrugated board is of the commodity type and can be purchased from any supplier, translating into low costs. Additionally, only two or three differently sized materials are required in the most preferred form to reduce inventory requirements and increase the possibility of price reductions due to the numbers of components produced. The fold lines along edges 22, 24, 38, 42 and 46 can then be created in conventional manners typically utilizing automated equipment and preferably created in line at the product production facility resulting in cost savings. The parallel and linear nature of edges 22, 24, 38, 42 and 46 in the most preferred form increases the ease of creation of panels 12–15. Furthermore, due to their identical construction, any fabricated panel can be utilized interchangeably as any one of panels 12–15 in tote 10 according to the preferred teachings of the present invention to thus reduce inventory requirements.

Now that the basic teachings of the present invention have been explained, many extensions and variations will be obvious to one having ordinary skill in the art. For example, in the preferred form, tote 10 according to the teachings of the present invention incorporates several unique features and it is believed that such incorporation produces synergistic results. However, it can be appreciated that such features can be utilized separately or in a variety of other combinations according to the teachings of the present invention.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Tote comprising, in combination: a tubular tote body having open top and bottom ends; a top panel; and a bottom panel, with the top and bottom panels being independent from and closing the open ends of the tubular tote body, with the tubular tote body comprising, in combination: first, second, third, and fourth side panels, with each of the side panels including a central portion having first and second side edges and including first and second flaps, with the first flap integrally connected to and extending from the first side edge and the second flap integrally connected to and extending from the second side edge, with the flaps of the side panels overlapping and being secured to the central portions of the adjacent side panels forming the tote body, with corners of the tubular tote body being defined by the first and second side edges of the side panels, with the flaps extending in two, nonparallel directions from the corners of the tubular tote body and with the central portions create a V-shaped corner post at each corner of the tubular tote body.

2. The tote of claim 1 wherein the first and second flaps of the first and third side panels are located outside of the central portions of the second and fourth side panels and the first and second flaps of the second and fourth panels are located inside of the central portions of the first and third side panels such that the central portions of the first and third side panels are unobstructed by flaps extending outside thereof.

3. The tote of claim 2 wherein the side panels are of identical construction to reduce inventory requirements.

4. The tote of claim 3 wherein the side panels are formed of double-wall corrugated board.

5. The tote of claim 2 wherein the flaps are planar.

6. The tote of claim 5 wherein the central portions each include an outer face which is planar.

7. The tote of claim 1 wherein the side panels are of identical construction to reduce inventory requirements.

8. The tote of claim 7 wherein the side panels are formed of double-wall corrugated board.

9. The tote of claim 6 wherein the central portion of each of the side panels includes an outer face and a pleat located between the first and second side edges and extending inwardly of the outer face, with the pleat increasing compressive strength and rigidity of the side panel.

10. The tote of claim 9 wherein the central portion of each of the side panels further includes at least a first patch bonded to the outer face and extending across the pleat for reducing any tendency for the side panel to bulge.

11. The tote of claim 9 wherein the pleat comprises, in combination: a first planar wall having a first wall edge; and a second planar wall having a first wall edge integrally connected to the first wall edge of the first planar wall, with the second planar wall extending at an acute angle to the first planar wall.

12. The tote of claim 11 wherein the first planar wall further has a second wall edge and the second planar wall further has a second wall edge, with the width between the first and second wall edges of the first planar wall being equal to the width between the first and second wall edges of the second planar wall.

13. The tote of claim 12 wherein the central portion of each of the side panels further includes a third planar wall having the first side edge and a first wall edge integrally connected to the second wall edge of the first planar wall and a fourth planar wall having the second side edge and a first wall edge integrally connected to the second wall edge of the second planar wall.

14. The tote of claim 13 wherein the width between the first side edge and the first wall edge of the third planar wall is equal to the width between the second side edge and the first wall edge of the fourth planar wall.

15. The tote of claim 9 wherein the pleat is parallel to and intermediate the first and second side edges.

16. The tote of claim 1 wherein the central portion of each of the side panels includes an outer face and a pleat located between the first and second side edges and extending inwardly of the outer face, with the pleat increasing compressive strength and rigidity of the side panel.

17. Tote comprising, in combination: at least a first panel, with the first panal including first and second planar walls and at least a first pleat located between and integrally connected to the first and second planar walls, with the first and second planar walls having an outer face, with the pleat extending inwardly of the outer face of the first and second planar walls; and at least a first patch bonded to the outer face of the first and second planar walls and extending across the pleat for reducing any tendency for the panel to bulge, with the pleat increasing compressive strength and rigidity of the panel.

18. The tote of claim 17 wherein the pleat comprises, in combination: a third planar wall having a first wall edge; and a fourth planar wall having a first wall edge integrally connected to the first wall edge of the third planar wall, with the fourth planar wall extending at an acute angle to the third planar wall.

19. The tote of claim 18 wherein the third planar wall further has a second wall edge and the fourth planar wall further has a second wall edge, with the width between the first and second wall edges of the third planar wall being equal to the width between the first and second wall edges of the fourth planar wall.

20. The tote of claim 19 wherein the first planar wall has a first wall edge integrally connected to the second wall edge of the third planar wall and the second planar wall has a first wall edge integrally connected to the second wall edge of the fourth planar wall.

21. The tote of claim 20 wherein the first planar wall includes a first side edge and the second planar wall includes a second side edge, with the width between the first side edge and the first wall edge of the first planar wall being equal to the width between the second side edge and the first wall edge of the second planar wall.

22. The tote of claim 21 wherein the pleat is parallel to and intermediate the first and second side edges.

23. Tote comprising, in combination: at least a first panel, with the first panel including first and second planar walls and at least a first pleat located between and integrally connected to the first and second planar walls, with the first and second planar walls having an outer face, with the pleat extending inwardly of the outer face of the first and second planar walls; and with the first panel further including a central wall having first and second side edges, with the first and second planar walls being bonded to the central wall intermediate the first and second side edges, with the central wall extending across the pleat for reducing any tendency for the panel to deflect, with the pleat increasing compressive strength and rigidity of the panel.

24. The tote of claim 23 wherein the pleat comprises, in combination: a third planar wall having a first wall edge; and a fourth planar wall having a first wall edge integrally connected to the first wall edge of the third planar wall, with the fourth planar wall extending at an acute angle to the third planar wall.

25. The tote of claim 24 wherein the third planar wall further has a second wall edge and the fourth planar wall further has a second wall edge, with the width between the first and second wall edges of the third planar wall being equal to the width between the first and second wall edges of the fourth planar wall 26. The tote of claim 25 wherein the first planar wall has a first wall edge integrally connected to the second wall edge of the third planar wall and the second planar wall has a first wall edge integrally connected to the second wall edge of the fourth planar wall.

* * * * *